US006262384B1

(12) United States Patent
Niebler et al.

(10) Patent No.: US 6,262,384 B1
(45) Date of Patent: Jul. 17, 2001

(54) SWITCHING DEVICE HAVING AN ARC EXTINGUISHING DEVICE

(75) Inventors: Ludwig Niebler, Laaber; Christian Schreckinger, Kötzting, both of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/554,935

(22) PCT Filed: Nov. 9, 1998

(86) PCT No.: PCT/DE98/03272

§ 371 Date: May 22, 2000

§ 102(e) Date: May 22, 2000

(87) PCT Pub. No.: WO99/27553

PCT Pub. Date: Jun. 3, 1999

(30) Foreign Application Priority Data

Nov. 21, 1997 (DE) ..... 297 20 715

(51) Int. Cl.[7] ..... H01H 33/02; H01H 33/08

(52) U.S. Cl. ..... 218/156; 218/15; 218/34

(58) Field of Search ..... 218/15, 16–18, 218/34–36, 149, 151, 154, 155–157, 22; 335/16, 147, 195, 201, 202, 132

(56) References Cited

U.S. PATENT DOCUMENTS

| | | | | |
|---|---|---|---|---|
| 2,030,582 | * | 2/1936 | Graves, Jr. | 218/154 |
| 2,363,606 | * | 11/1944 | Maseng | 218/154 |
| 2,468,422 | | 4/1949 | Wood . | |
| 2,942,083 | * | 6/1960 | Walker et al. | 218/154 |
| 4,393,287 | | 7/1983 | Nakano . | |
| 5,164,693 | * | 11/1992 | Yakoyama et al. | 335/14 |

FOREIGN PATENT DOCUMENTS

| | | | |
|---|---|---|---|
| 1 185 369 | | 1/1965 | (DE) . |
| 1 238 538 | | 4/1967 | (DE) . |
| 2567323 | * | 7/1984 | (DE) . |
| 44 10 108 | | 9/1995 | (DE) . |
| 0 164 632 | | 12/1985 | (EP) . |
| 2 511 187 | | 2/1983 | (FR) . |

OTHER PUBLICATIONS

A. Erk and M. Schmelzle, "Grundlagen, der Schalterätetechnik", Springer Verlag, 1974, pp. 268–272* (No Month).

* cited by examiner

*Primary Examiner*—Lincoln Donovan
*Assistant Examiner*—Tuyen T. Nguyen
(74) *Attorney, Agent, or Firm*—Birch, Stewart, Kolasch & Birch, LLP

(57) ABSTRACT

A switching device is provided having an optimally used arcing chamber. To this end, a lower arc runner plate extends into a space located behind the arcing chamber, and an upper arc runner plate is positioned off from this space by an appropriate design of an insulating strip of the arcing chamber (10). The insulating strip is provided with projecting tabs for this purpose.

4 Claims, 6 Drawing Sheets

SWITCHING DEVICE HAVING AN ARC EXTINGUISHING DEVICE

FIELD OF THE INVENTION

The present invention relates to a switching device having a stationary contact and having a moving contact, which together form a contact point. The switching device further includes an arc extinguishing device which is used to extinguish any arc that occurs at this contact point. The arc extinguishing device includes an assembly which is designed as an arcing chamber and is composed of a number of arc splitter plates which are held parallel and at a distance from one another by means of an insulating strip. The arc extinguishing device also includes a first and a second arc runner plate, in which case the two arc runner plates are each arranged adjacent to one of the outer arc splitter plates of the arc extinguishing device, and in which case the insulating strip has a wall which forms the arcing chamber termination and at which the arc splitter plates end.

BACKGROUND INFORMATION

A switching device of this generic type has been available on the electrical equipment market for many years. In such switching devices or protective devices, an arc occurs at the opening contact points when electric currents are being disconnected. This arc causes wear at the contact points due to the contact material burning away, and delays the disconnection of the circuit, since the current continues to flow via the arc until the arc is extinguished. In order to limit the damage caused by the arc, electrical switching devices or protective devices beyond a certain rating are equipped with an arc extinguishing device.

Such an arc extinguishing device often comprises, as shown in FIG. 4, an arcing chamber 1 with arc runner plates 2 and 3, and various components which, inter alia, also carry out tasks relating to flow.

According to FIG. 5, the arcing chamber 1 is designed as a pack of arc splitter plates 4, which are stamped in a U-shape, are arranged parallel and are held at a distance from one another. A strip of insulating material, generally a vulcanized fiber strip 5, is folded around the arc splitter plates 4, keeps the arc splitter plates 4 at a distance from one another, and forms an assembly. Openings 6 are stamped in the insulating strip 5 and, inter alia, influence the flow behavior in the arcing chamber 1. The runner plates 2 and 3 are arranged at the upper end and at the lower end of the arcing chamber 1, according to FIG. 4. Together with a moving contact link 7, the upper arc runner plate 2 forms a contact point 8.

FIG. 6 shows a cross-section illustration of the arc extinguishing device to show how the arc moves from the contact point into the arcing chamber. When the contact point 8 opens, an arc 9 is formed between the contacts as they move away from one another. Electromagnetic forces move the arc 9 in the direction of the arc extinguishing chamber 1. The roots of the arc 9 at the outlet points of the arc runner plates 2 and 3 in this case move away from the contact point 8 along the arc runner plates 2 and 3, which are electrically connected to the circuit. The arc runner plates 2 and 3 are in this case formed and arranged such that they lead the arc to the arcing chamber 1 as quickly as possible. The arc 9 is then extinguished in the inner part of the arcing chamber 1. During the described sequence, electromechanical and thermomechanical forces occur between the arc splitter plates 4 and the arc runner plates 2 and 3. If the arc runner plates 2 and 3 are not fixed to be sufficiently robust—and it is often the case that they are not adequately fixed owing to the design characteristics—they touch the outer arc splitter plates 4, and are welded to them. This reduces the efficiency of the arcing chamber 1 for further extinguishing processes. In the case of particularly severe arcs, such as those which occur as a consequence of short-circuit disconnections, there is a risk of these arcs running through the arcing chamber and being short-circuited behind it. In this case, the arcing chamber no longer has any extinguishing effect.

The following solutions are already known to prevent the arc from being short-circuited in the space located behind the arcing chamber. The arc runner plates are kept relatively short, that is to say they do not continue to the end of the arcing chamber, where the arc splitter plates end. Another option is to dispense with the lower arc runner plate entirely. Normally, the arc runner plates that are kept very short are either not mechanically supported at all, or else an additional plastic part is used for support, although this involves corresponding additional costs. The solution with short runner plates has the major disadvantage that, in some circumstances, the entire volume of the inner part of the arcing chamber is not used optimally during the extinguishing process.

SUMMARY

An object of the present invention is to provide an improved switching device in which the extinguishing effect of the arcing chamber is used optimally, while at the same time precluding the risk of the arc being short-circuited in the space located behind the arcing chamber.

This object is achieved in that one of the arc runner plates projects beyond the wall of the insulating strip into a space located behind the arcing chamber, and the other arc runner plate is partitioned off from the space located behind the arcing chamber by means of the wall of the insulating strip in conjunction with a housing wall. This configuration results in optimum efficiency of the arc extinguishing device. The specified partitioning of one of the arc runner plates makes it impossible for the arc to be short-circuited in the space located behind the arcing chamber.

A particularly advantageous refinement of the present invention results from one of the arc runner plates being supported such that it cannot move toward the closest arc splitter plate.

The support is advantageously provided on the wall of the insulating strip. Furthermore, it is advantageous if the arc runner plate which is partitioned off from the space located behind the arcing chamber extends, except for an installation clearance, to the wall of the insulating strip, in order to use the extinguishing effect of the arcing chamber optimally.

The solution according to the present invention requires neither any additional parts nor any additional assembly steps. The solution can be achieved in a simple manner by using a slightly increased amount of material, thus involving minor additional costs for the insulating strip.

DETAILED DESCRIPTION

Figure 1:
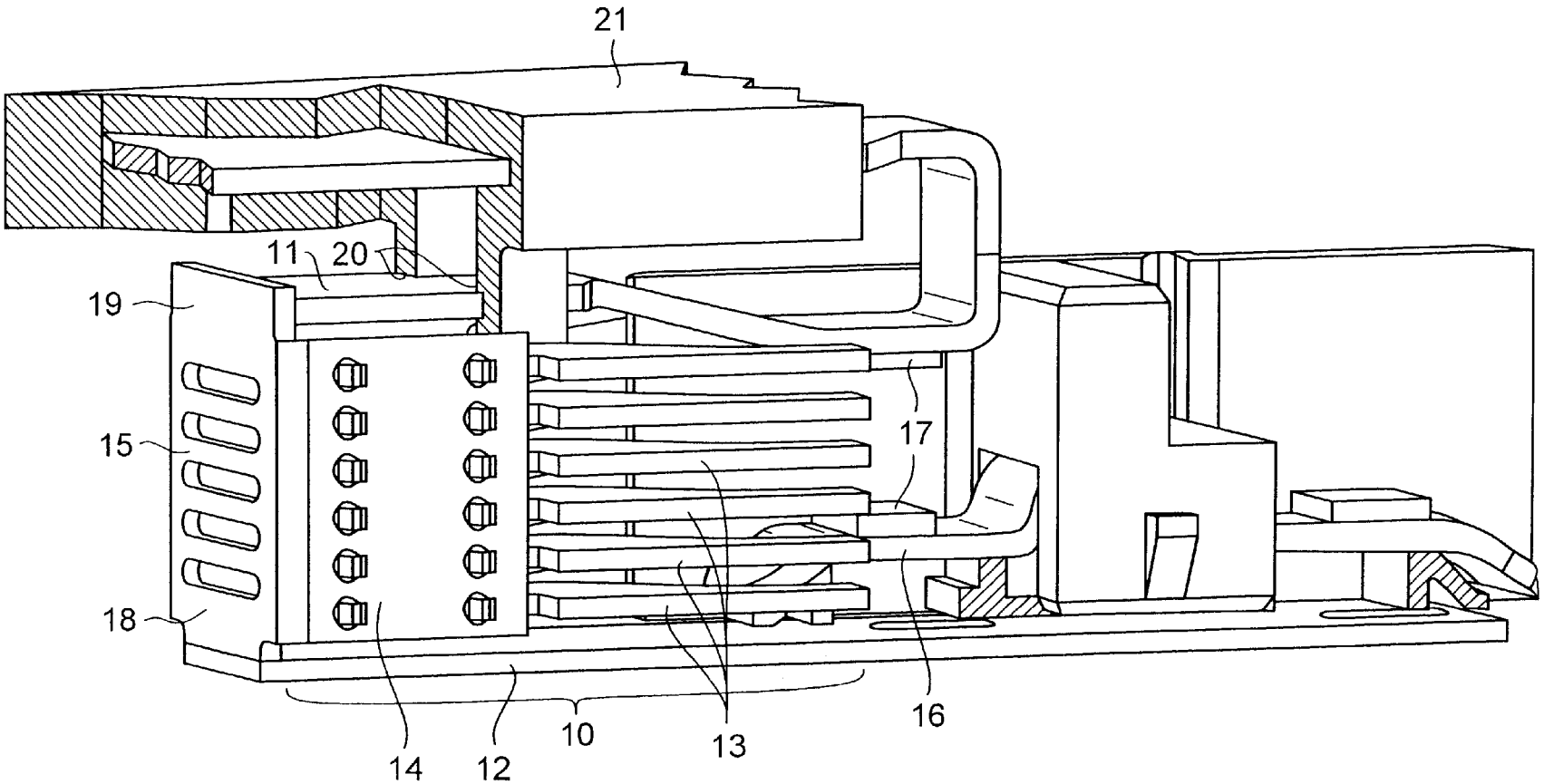
FIG. 1 shows a perspective view of an arc extinguishing device according to the invention, interacting with a contact point.

FIG. 1 shows an arc extinguishing device including an arcing chamber 10 having an upper 11 and a lower arc runner plate 12. The arcing chamber 10 is designed as a pack composed of arc splitter plates 13 which are stamped in a U-shape, arranged parallel and held at a distance from one another. An insulating strip 14 is folded around the arc splitter plates 13, keeps the arc splitter plates 13 at a distance from one another, and forms an assembly. The insulating strip 14 has a wall 15 which forms the arcing chamber 10 termination and at which the arc splitter plates 13 end. The upper arc runner plate 11, which is arranged parallel to a topmost arc splitter plate 13 forms, together with a moving contact link 16, a contact point 17 on which an arc is formed when the contact opens, that is to say when the switching device trips. The lower arc runner plate 12 is arranged parallel to a bottom arc splitter plate 13 and projects beyond the wall 15 of the insulating strip 14 into the space located behind the arcing chamber 10 (see FIG. 2).

The lower arc runner plate 12 is supported by a projecting tab 18 of the wall 15, so that, on the one hand, this prevents any movement toward the closest arc splitter plate 13 while, on the other hand, prevents the arc root from moving on the lower arc runner plate 12 into the space located behind the arcing chamber 10.

Figure 2:
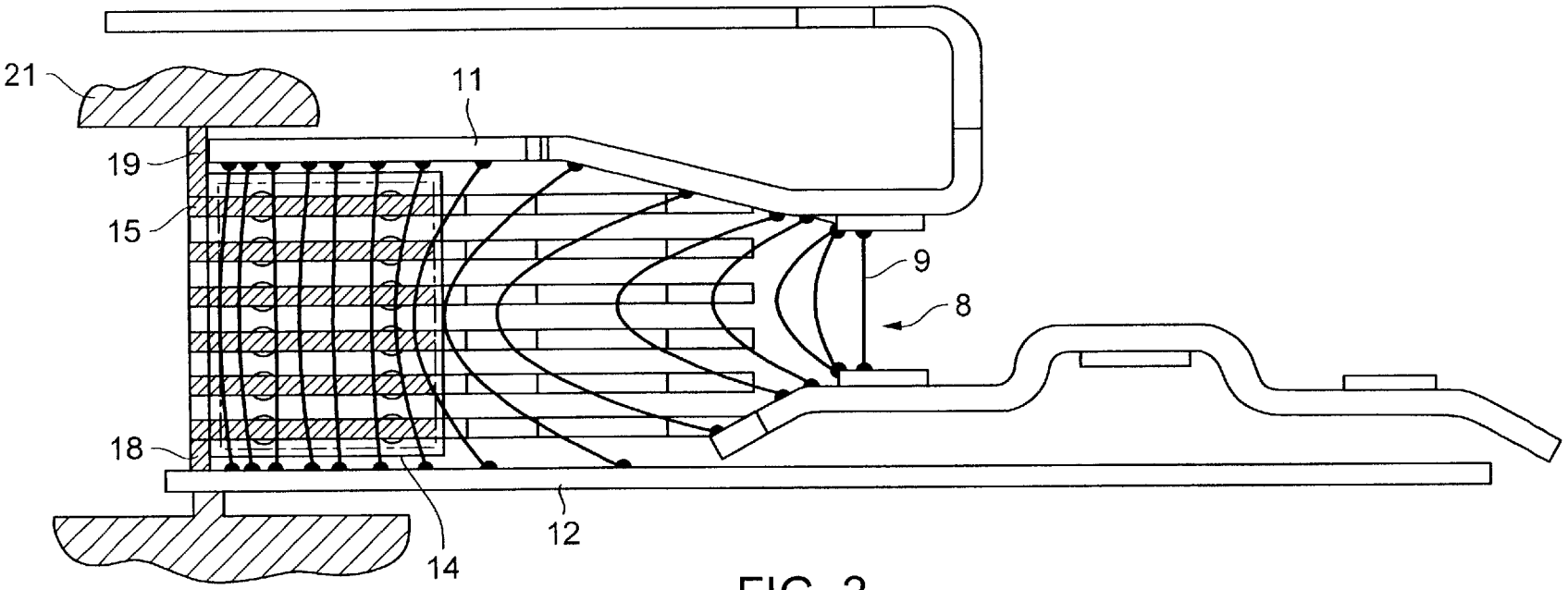
FIG. 2 shows a section view of an arc extinguishing device according to the invention, interacting with a contact point.

The upper arc runner plate 11 is guided on a projecting tab 19 of the wall 15, except for an installation clearance. It is inserted in a groove 20 in the housing, of which the housing detail 21 is illustrated here. Fixing in the housing likewise results in the upper arc runner plate 11 not being able to move toward the upper arc splitter plate 13 of the arcing chamber 10. The upper projecting tab 19 of the wall 15, in conjunction with the housing, results in the upper arc runner plate 11 being partitioned off from the space located behind the arcing chamber 10, thus preventing the undesirable short-circuiting of the arc mentioned above. FIG. 2 shows the method of operation of the arc extinguishing device improved in this way. On the one hand, the arc runner plates 11 and 12 have a length which uses the arcing chamber 10 optimally, while the support of the lower arc runner plate 12 and the partitioning off of the upper arc runner plate 11 prevent the risk of the arc being short-circuited behind the arcing chamber 10. As is seen in FIG. 2, the wall 15 has been extended upward and downward by projecting tabs 18 and 19.

As can be seen from FIG. 2, it is furthermore expedient for the arc runner plate 12 also to be supported at the bottom by the housing, thus producing partitioning in the same way as that for the upper arc runner plate 11, so that the arc root can move only as far as the wall 15 of the insulating strip 14.

Figure 3:
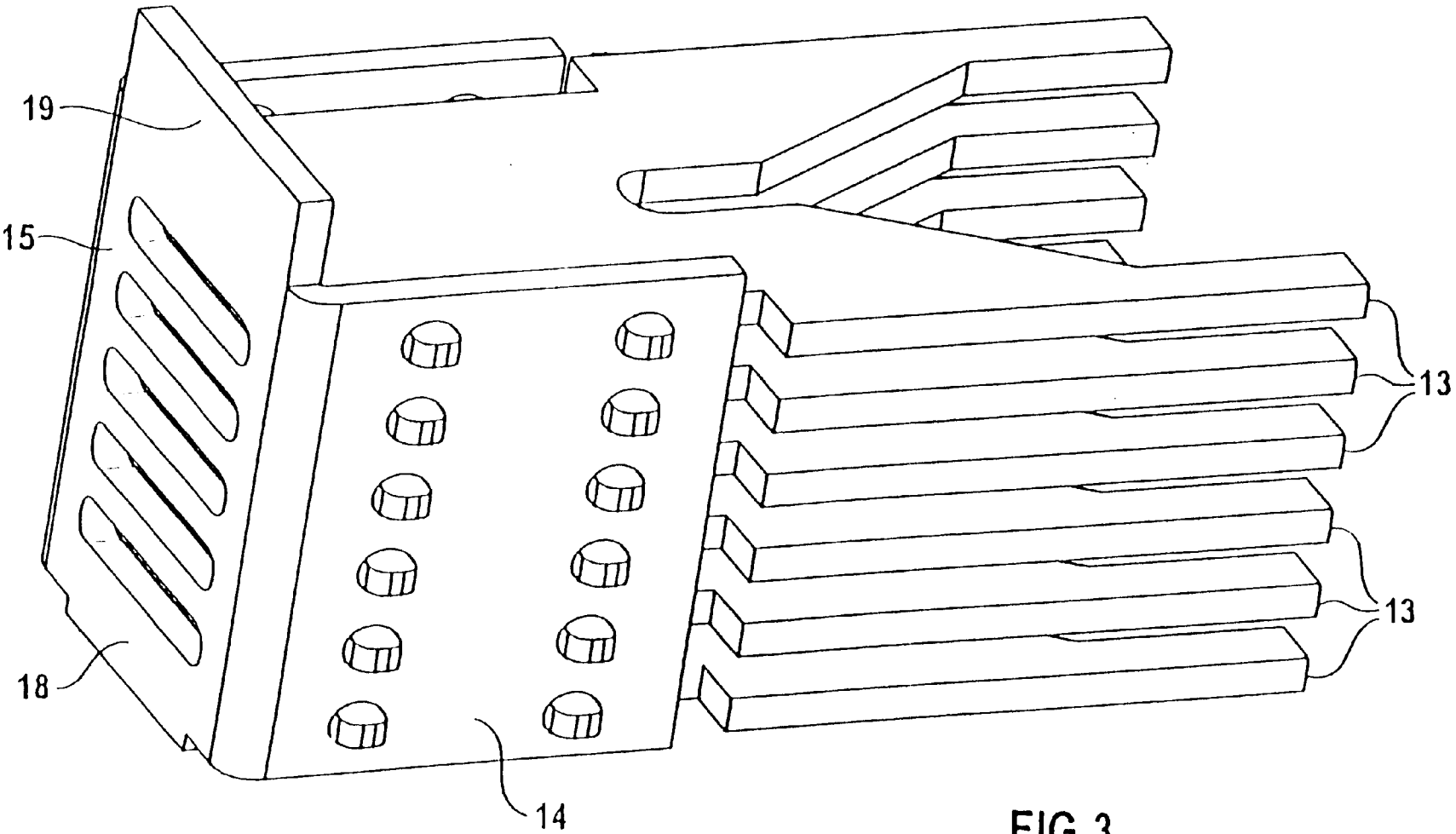
FIG. 3 shows an arcing chamber of the arc extinguishing device as shown in FIGS. 1 and 2.
Figure 4:
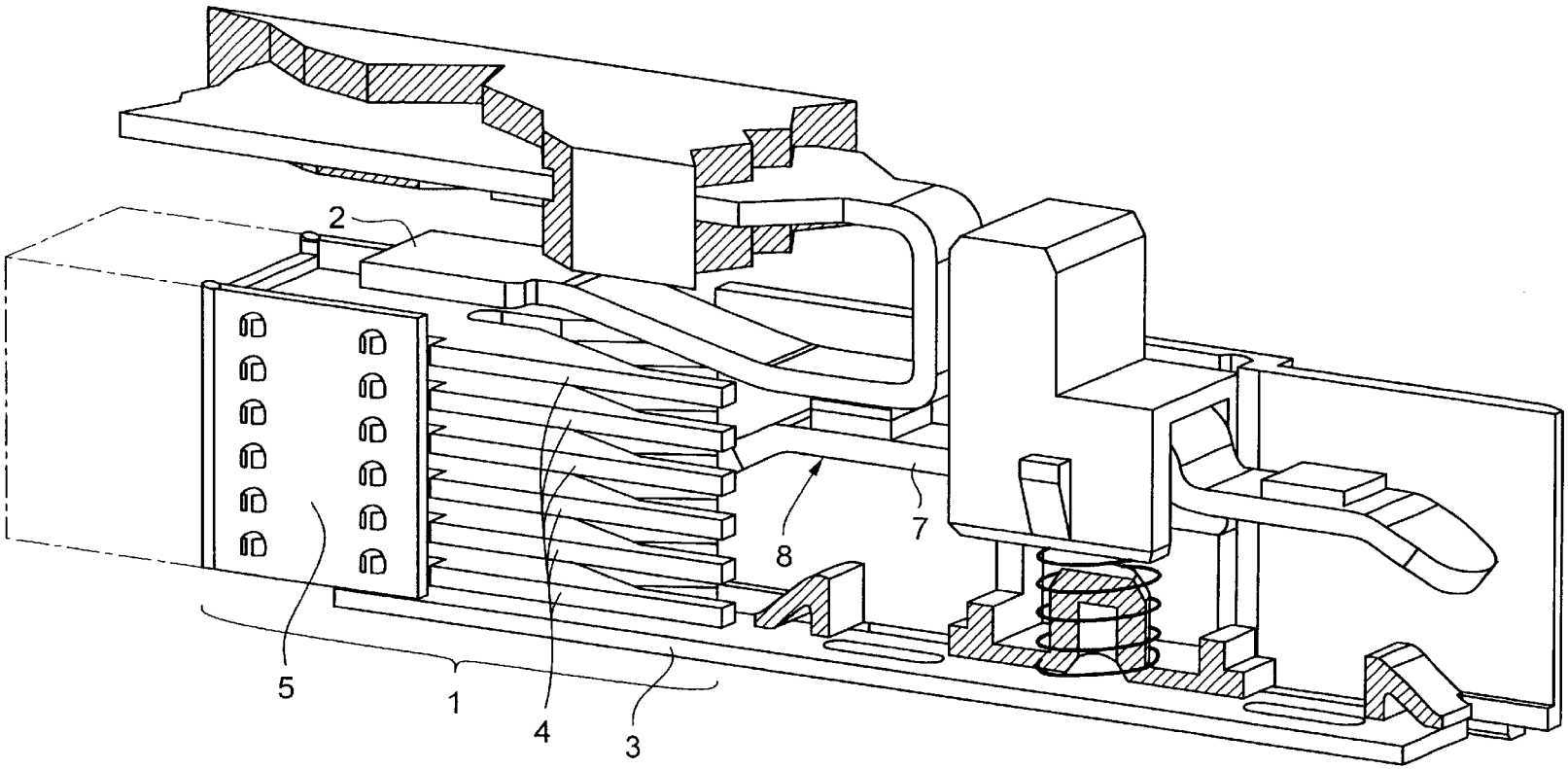
FIG. 4 Conventional Art
FIG. 4 shows a known version of an arc extinguishing device.
Figure 5:
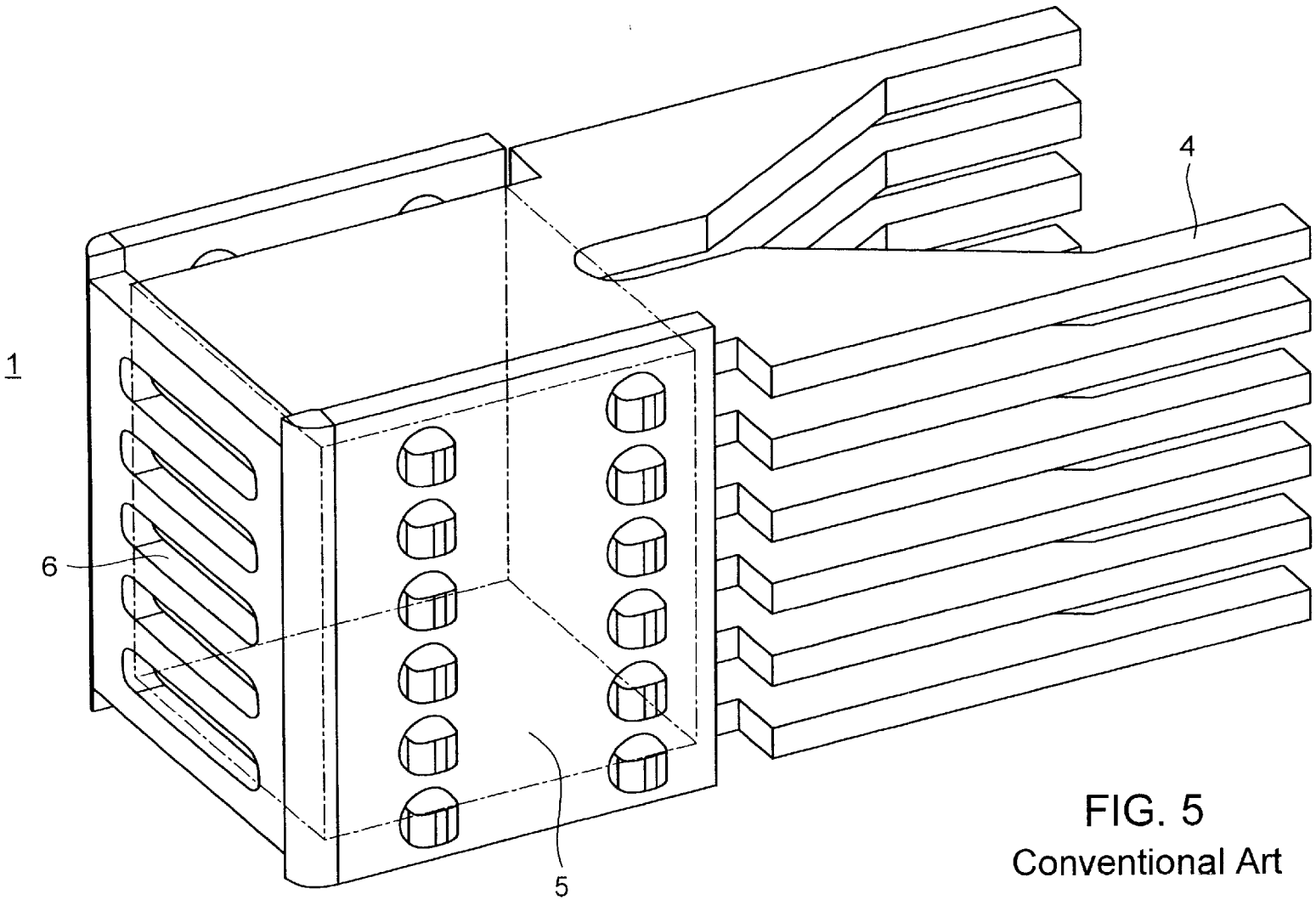
FIG. 5 Conventional Art
FIG. 5 shows an arcing chamber of the arc extinguishing device shown in FIG. 4.
Figure 6:
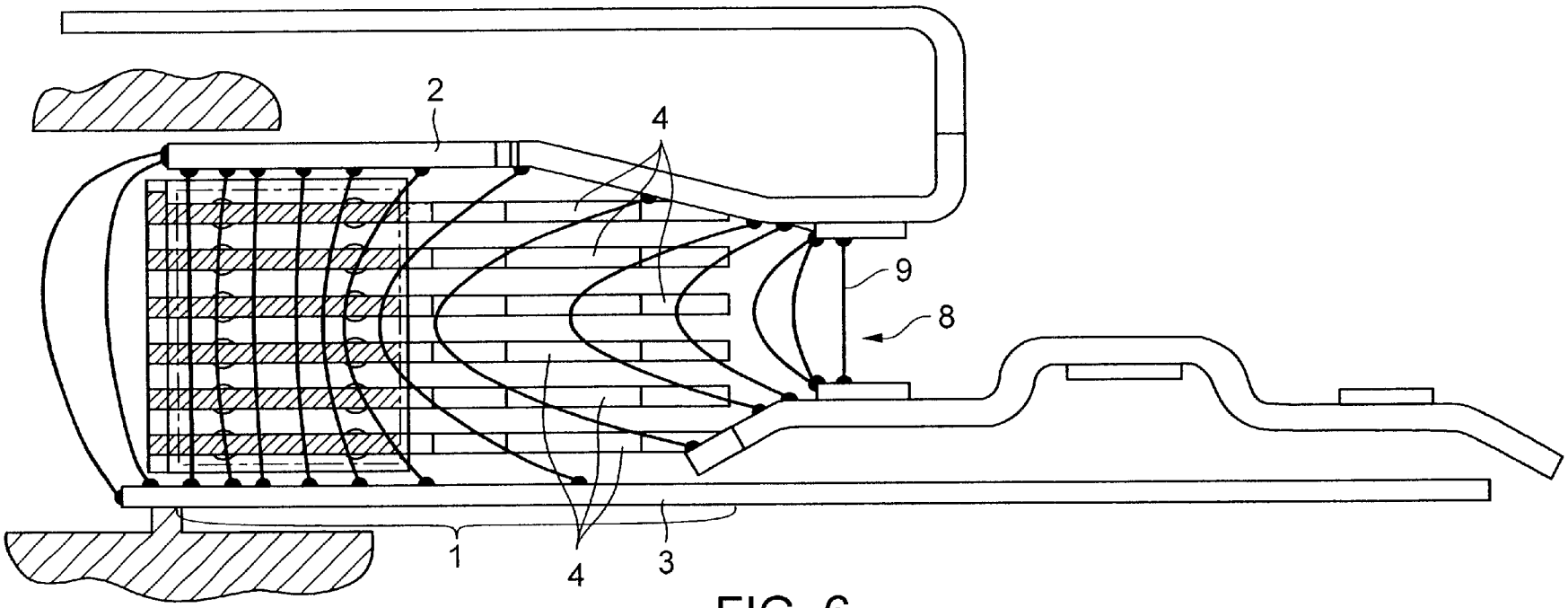
FIG. 6 Conventional Art
FIG. 6 shows a cross-section illustration of the known arc extinguishing device, showing the extinguishing effect, in conjunction with the movement of the arc into the arcing chamber.

FIG. 3 shows the arcing chamber 10 with the pack composed of arc splitter plates 13 and held together by the insulating strip 14. As mentioned above, the wall 15 is extended upward and downward by projecting tabs 18 and 19.

What is claimed is:

1. A switching device, comprising:

a stationary contact and a moving contact, the stationary contact and the moving contact together forming a contact point; and an arc extinguishing device for extinguishing an arc occurring at the contact point, the arc extinguishing device including an arcing chamber, the arcing chamber including arc splitter plates held parallel to one another and at a distance from one another using an insulating strip, the arcing chamber further including a first and a second arc runner plate, each of the first and second arc runner plates being arranged adjacent to an outer arc splitter plate, respectively, the insulating strip including a wall which forms the arcing chamber termination and at which the arc splitter plates end, a first one of the first and second arc runner plates projecting beyond the wall of the insulating strip into a space located behind the arcing chamber, a second one of the first and second arc runner plates being partitioned off from the space located behind the arcing chamber using the wall of the insulating strip in conjunction with a housing wall.

2. The switching device according to claim 1, wherein one of the first and second arc runner plates is supported in a stationary manner, thereby preventing movement thereof towards a closest one of the arc splitter plates.

3. The switching device according to claim 2, wherein the wall of the insulating strip provides the support for the one of the first and second arc runner plates.

4. The switching device according to claim 1, wherein a distal end of the second arc runner plate is positioned substantially adjacent to the wall of the insulating strip, whereby an installation clearance is remained therebetween.

* * * * *